US005913838A

United States Patent [19]

Reilly

[11] Patent Number: 5,913,838

[45] Date of Patent: Jun. 22, 1999

[54] VIBRATING FOOT MASSAGE INSOLE APPARATUS

[76] Inventor: Peter C. Reilly, Three Hanover Sq., New York, N.Y. 10004

[21] Appl. No.: 08/871,607

[22] Filed: Jun. 9, 1997

[51] Int. Cl.[6] ..... A61H 1/00

[52] U.S. Cl. ..... 601/58; 601/30; 601/46; 601/56; 36/136; 36/141

[58] Field of Search ..... 601/46, 56, 57, 601/58, 59, 60, 67, 69, 70, 71, 78, 79, 81, 30; 36/141, 136

[56] References Cited

U.S. PATENT DOCUMENTS

| | | | |
|---|---|---|---|
| 4,513,736 | 4/1985 | Thurber | 601/57 |
| 4,802,463 | 2/1989 | Rojas | 601/70 |
| 4,989,584 | 2/1991 | Simon | 601/70 |
| 5,029,575 | 7/1991 | Zhivotchenko et al. | 607/27 |
| 5,113,850 | 5/1992 | Larremore et al. | 601/46 |
| 5,357,696 | 10/1994 | Gray et al. | 36/136 |
| 5,592,759 | 1/1997 | Cox | 36/141 |

*Primary Examiner*—Richard J. Apley
*Assistant Examiner*—Benjamin K. Koo
*Attorney, Agent, or Firm*—Charles E. Baxley, Esq.

[57] ABSTRACT

An insole which can be placed in a user's shoe incorporates vibrators which provide a vibrating massage. The vibrators are connected to a battery operated power supply which can be attached to a users leg by an elastic strap or attached to a user's shoe by a clip. A wire retraction unit is mounted on the power supply to take up slack in an electrical cable which connects the vibrators and the power supply.

16 Claims, 5 Drawing Sheets

VIBRATING FOOT MASSAGE INSOLE APPARATUS

BACKGROUND OF INVENTION

The present invention relates generally to footwear and more particularly to a vibrating foot massage insole apparatus which can be installed in footwear.

The prior art related to relieving foot discomfort includes various insoles which are intended to apply static pressure to various portions of the sole of the foot. These devices rely on combinations of curved surfaces, pads, protrusions, relatively stiff surfaces and relatively soft surfaces to apply various types of static pressure as a result of the application of pressure by the user's foot.

Despite the various developments of the prior art there remains a need for an apparatus which can apply a vibrating massage to the soles of a user's feet and which can be easily removed from and installed into various pairs of shoes or boots.

OBJECTS AND SUMMARY OF INVENTION

It is an object of the present invention to provide a vibrating foot massage insole apparatus which can be easily installed in a pair of shoes to deliver a vibrating massage to the soles of a user's feet.

Another object of the present invention is to provide a vibrating foot massage insole apparatus which incorporates air channels to prevent overheating of components and to provide cooling air to the foot.

Another object of the present invention is to provide a vibrating foot massage insole apparatus which incorporates a dual layer insole for increased foot comfort.

Another object of the present invention is to provide a vibrating foot massage insole apparatus which can be easily moved from shoe to shoe, thereby facilitating use of a single apparatus on a variety of different pairs of shoes or boots.

Another object of the present invention is to provide a vibrating foot massage insole apparatus in which unwanted slack in an electrical cable is taken up by a cable retraction unit.

Yet another object of the present invention is to provide a vibrating foot massage insole apparatus which utilizes a relatively small number of components, each of which can be manufactured economically resulting in relatively low overall cost and reliable long-term operation.

The foregoing and other objects and advantages of the present invention will appear more clearly hereinafter.

In accordance with the present invention there is provided a vibrating foot massage insole apparatus which includes a power supply unit which can be mounted on a user's leg or on a user's boot or shoe and vibrators which are mounted in circular beds which are formed in an insole. The power supply unit includes a battery compartment and is operated by pushing on a control button. A cable retraction unit is mounted on the power supply unit to take up unwanted slack in an electrical cable which connects the power supply unit and the vibrators.

BRIEF DESCRIPTION OF THE DRAWINGS

Other important objects and advantages of the present invention will be apparent from the following detailed description of the invention, taken in conjunction with accompanying drawings in which.

DETAILED DESCRIPTION OF THE INVENTION

Figure 1:
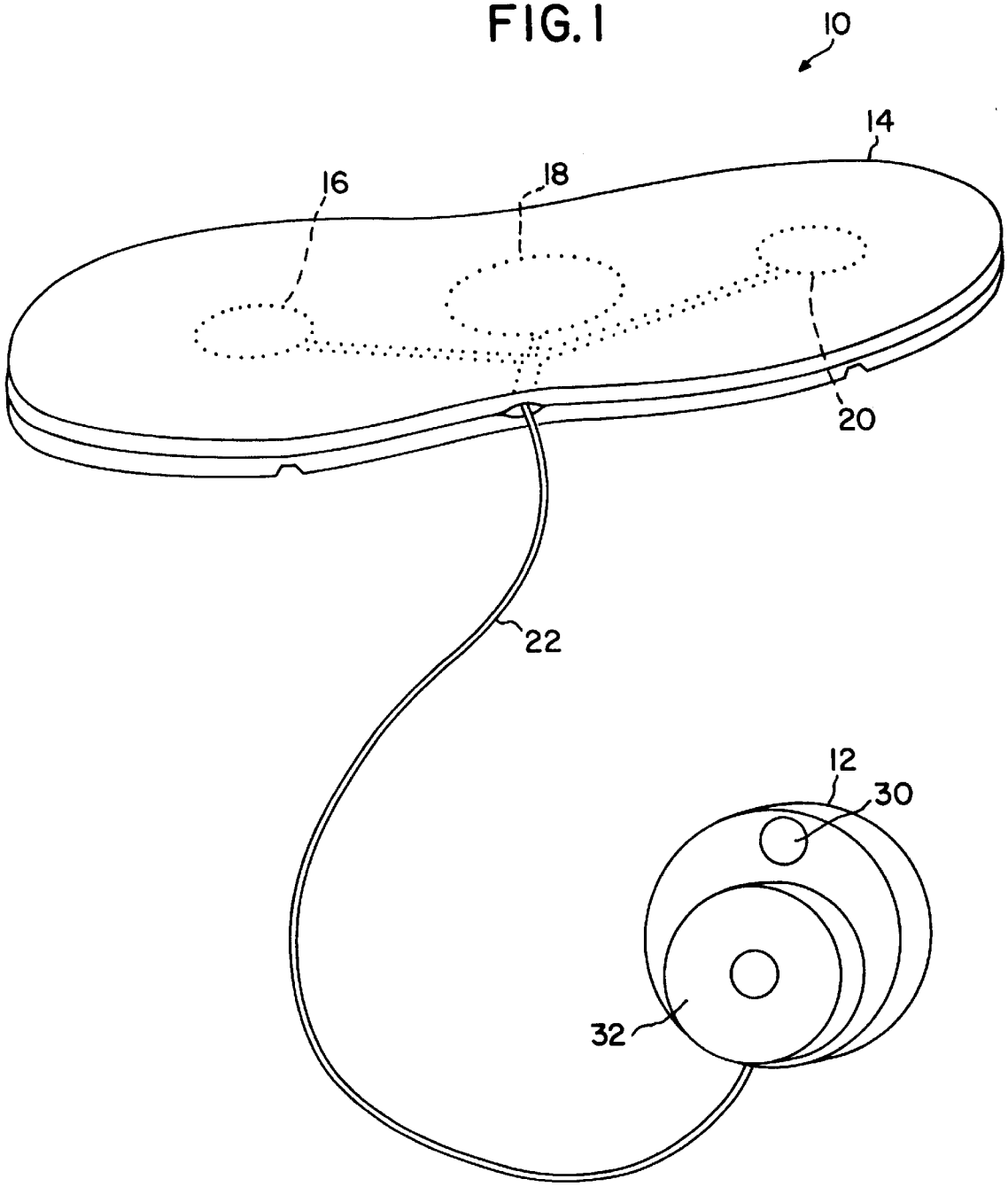
FIG. 1 is an overall perspective view of a vibrating foot massage insole apparatus made in accordance with the present invention.

With reference to the drawings, wherein like reference numbers designate like or corresponding parts throughout, there is shown in FIGS. 1–14 a vibrating foot massage insole apparatus 10 made in accordance with the present invention.

The vibrating foot massage insole apparatus 10 includes a power supply unit 12, an insole 14, a plurality of vibrators 16, 18, 20 which are shown in broken lines and an electrical cable 22 which connects power supply unit 12 and vibrators 16, 18, 20.

As is shown in FIGS. 2–5, power supply unit 12 is generally cylindrical and includes a generally flat and circular upper surface 24, a generally flat and circular lower surface 26 and a side wall 28. Upper surface 24 includes a control button 30 and a cable retracting unit 32.

Cable retracting unit 32 is generally cylindrical in configuration and includes a top surface 34 on which a cable release button 36 is mounted and a side wall 38 which includes a cable exit port 40. Cable retracting unit 32 includes a spring-loaded reel which is shown schematically in broken lines 42 in FIG. 2, to retract electrical cable 22 into cable retracting unit 32 in order to minimize slack, or excess wire, after installation of power supply unit 12 on a user's leg 44 or on a user's shoe 46. Details of construction of spring-loaded reel 42 are conventional in nature and devices of this type are found on vacuum cleaners and similar electrical appliances for retraction of power cords and therefore details of construction of spring-loaded reel 42 have not been shown. Operation of spring-loaded reel 42 is controlled by cable release button 36 which enables a user to take up the slack in electrical cable 22 after installation of the apparatus 10.

Lower surface 26 of power supply unit 12 includes a battery compartment cover 48 and a clip 50 which is used to mount power supply unit 12 in a manner which will be presently described.

Figure 2:
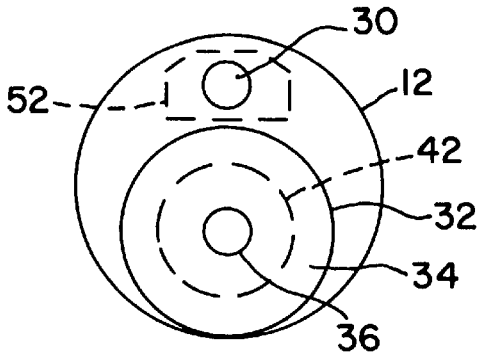
FIG. 2 is a top plan view of the power supply unit of the apparatus of FIG. 1.
Figure 3:
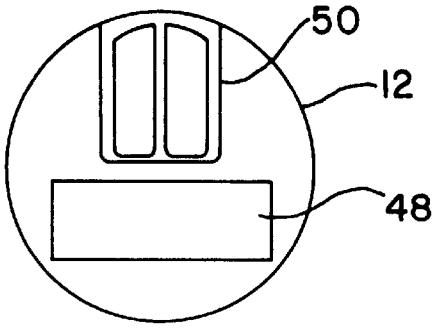
FIG. 3 is a bottom plan view of the power supply unit of the apparatus of FIG. 1.
Figure 4:
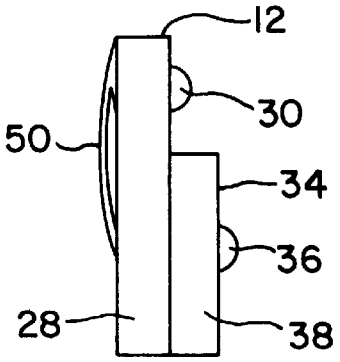
FIG. 4 is a side elevational view of the power supply unit of the apparatus of FIG. 1.
Figure 5:
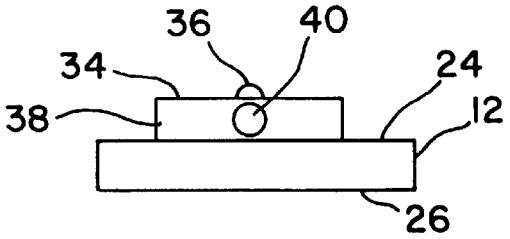
FIG. 5 is a front elevational view of the power supply unit of the apparatus of FIG. 1.

Control button 30 is connected to an electronic control unit which is conventional in construction and which is shown schematically in broken lines 52 in FIG. 2. The control unit 52 selectively provides three levels of vibrator operation (low, medium and high) which can be selected by selectively pressing control button 30 a preselected number of times. Control button 30 enables a user to turn power supply unit 12 on and off and also to select one of three levels of electrical output. Power supply unit 12 incorporates a timer which is equipped to power down the power supply unit 12 for a pre-selected time after a pre-selected period of operation. An appropriate duty cycle for the apparatus 10 has been developed in which power to the vibrators 16, 18, 20 is shut off for a period of three to five minutes after operation for a period of five to ten minutes. This duty cycle prevents unwanted over-heating of vibrators 16, 18, 20 and power supply unit 12.

Figure 6:
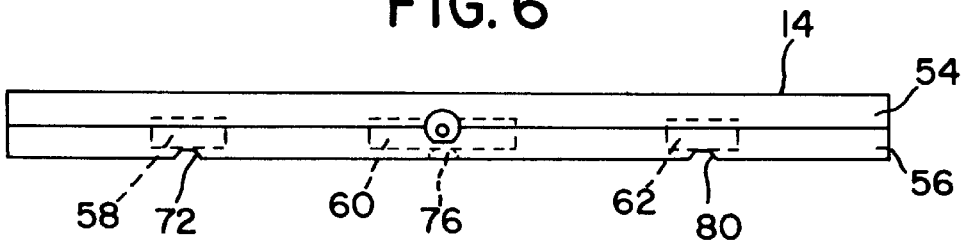
FIG. 6 is a side elevational view of the insole of the apparatus of FIG. 1.
Figure 7:
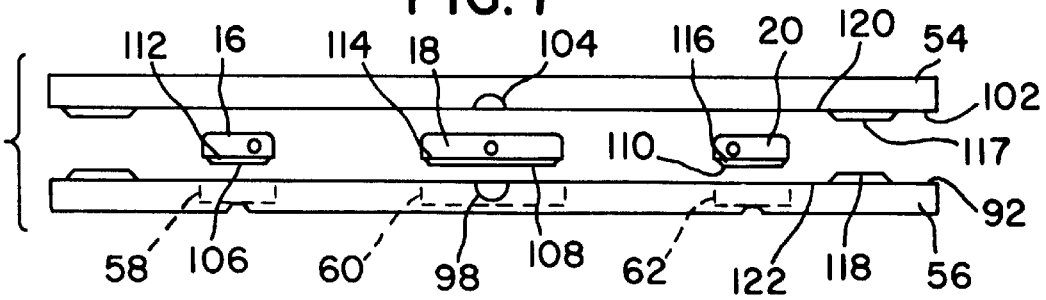
FIG. 7 is an exploded view of the insole of the apparatus of FIG. 1.
Figure 8:
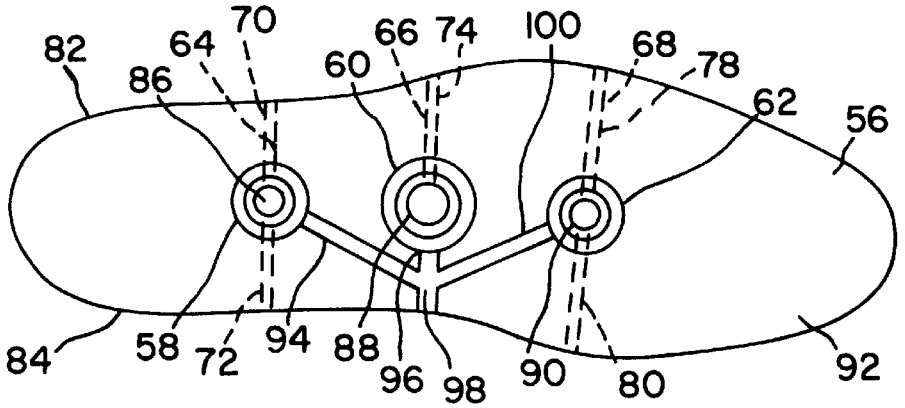
FIG. 8 is a top plan view of the lower portion of the insole of FIG. 6 with the vibrators removed.
Figure 9:
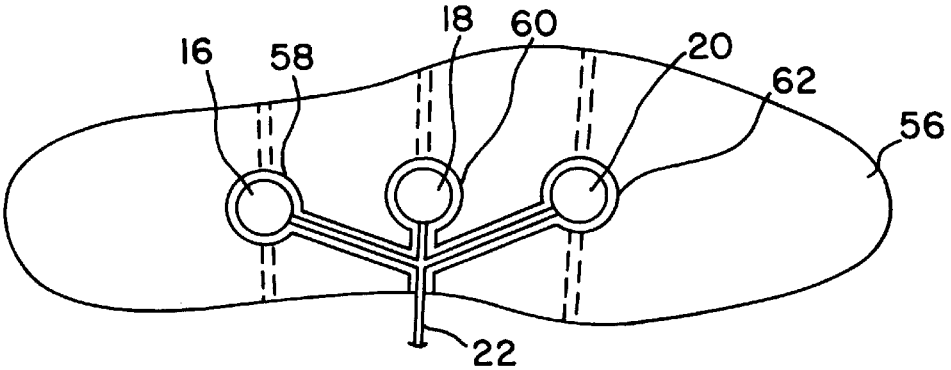
FIG. 9 is a top plan view of the lower portion of the insole of FIG. 9, similar to FIG. 8 with the vibrators installed.

Insole 14 has an upper portion 54 and a lower portion 56 as is shown in FIGS. 6 and 7. Lower portion 56 includes three recessed circular beds 58, 60, 62 for the vibrators 16, 18, 20 and a plurality of air canals 64, 66, 68. Air canals 64, 66, 68 are disposed transversely as shown in FIGS. 8 and 9 and segments 70, 72, 74, 78, 80 of the air canals 64, 66, 68 connect circular beds 58, 60, 62 with lateral edges 82, 84 of lower portion 56. Air holes 86, 88, 90 are provided in circular beds 58, 60, 62, thereby providing communication between circular beds 58, 60, 62 and air canals 64, 66, 68.

Upper surface 92 of lower portion 56 includes wire canals 94, 96, 98, 100 which lead from lateral edge 84 to circular beds 58, 60, 62. Wire canals 94, 96, 98, 100 facilitates installation of electrical cable 22 which connects vibrators 16, 18, 20, which are disposed in circular beds 58, 60, 62 to power supply unit 12.

Lower surface 102 of upper portion 54 includes a wire canal segment 104 which is in a facing relationship with wire canal segment 98. Vibrators 16, 18, 20 are secured to lower portion 56 by hook and loop fasteners 106, 108, 110 mounted on bottom surfaces 112, 114, 116 and corresponding hook and loop fasteners (not shown) mounted in circular beds 58, 60, 62.

Upper and lower portions 54, 56 of insole 14 are secured by hook and loop fasteners 117, 118 which are disposed in facing relationship on surfaces 120, 122. Lower portion 56 is preferably manufactured of a relatively firm or relatively rigid material and upper portion 54 is preferably manufactured of a perforated or a gel-like material which is less rigid than lower portion 56.

Vibrators 16, 18, 20 are constructed to be both water and shock resistant and hook and loop fasteners 117, 118 facilitate easy removal and replacement of the various components.

Figure 10:
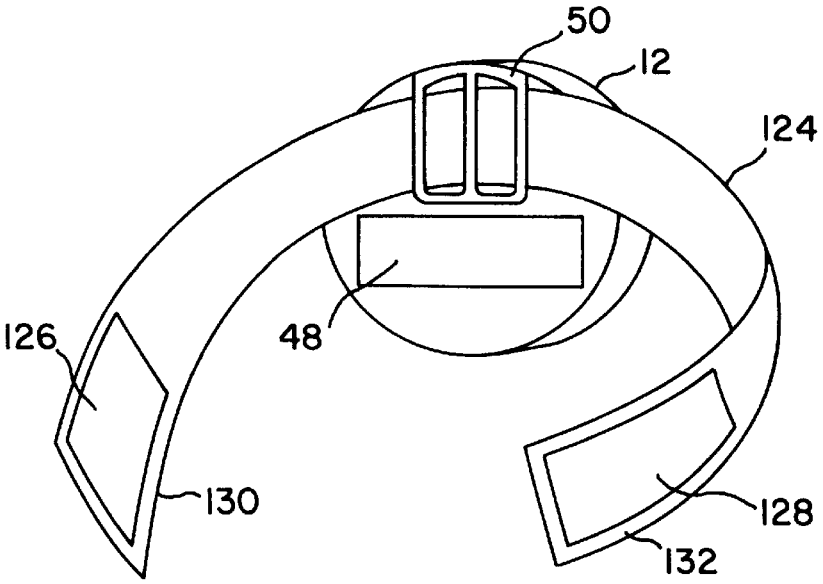
FIG. 10 is a perspective view of the power supply unit of the apparatus of FIG. 1, showing the detachable elastic strap.
Figure 11:
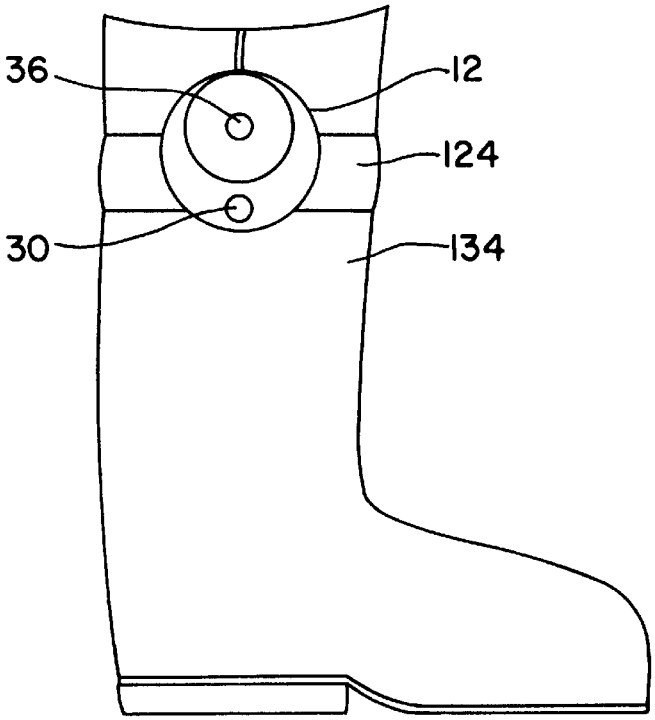
FIG. 11 is a side elevational view showing the power supply unit of the apparatus of FIG. 1 attached to a boot.
Figure 12:
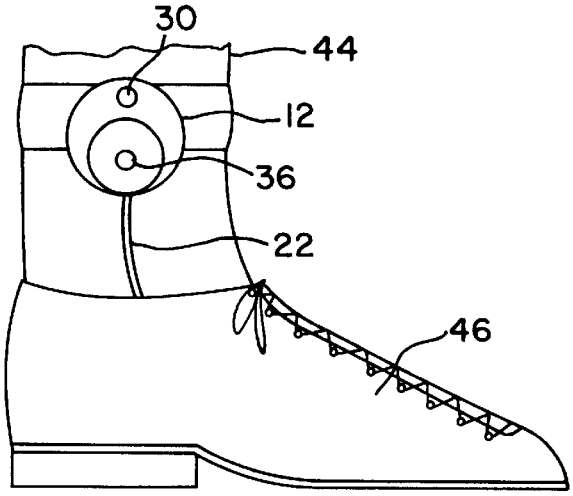
FIG. 12 is a side elevational view showing the power supply unit of the apparatus of FIG. 1 attached to a user's leg.
Figure 13:
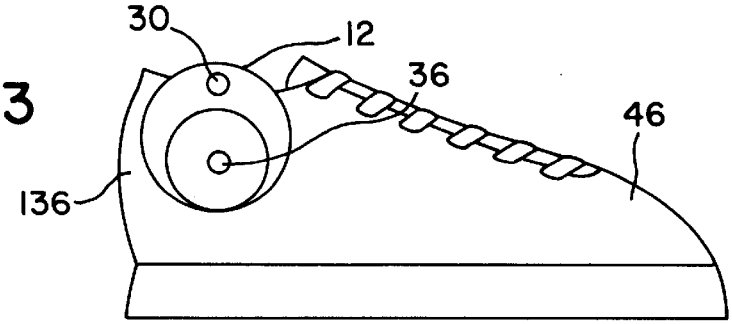
FIG. 13 is a side elevational view showing the power supply unit of the apparatus of FIG. 1 attached to the side of a shoe.
Figure 14:
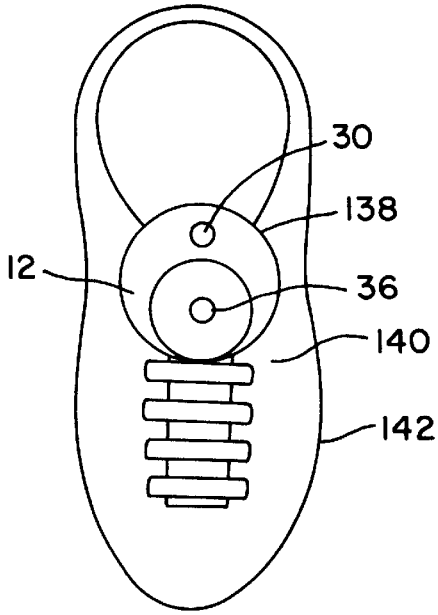
FIG. 14 is a side elevational view showing the power supply unit of the apparatus of FIG. 1 attached to the front of a shoe.

As is shown in FIG. 10, an elastic strap 124 is secured to power supply unit 12 by clip 50. Hook and loop fastener segments 126, 128 on ends 130, 132 of elastic strap 124 facilitate convenient attachment of power supply unit 12 to a user's boot 134, as is shown in FIG. 11, or to a user's leg 44 as is shown in FIG. 12. Clip 50 facilitates direct attachment of power supply 12 to the side 136 of a user's shoe 46 as is shown in FIG. 13. Alternatively, clip 50 can be used to attach power supply 12 to the top portion 138 of the front 140 of a user's shoe 142.

As is shown in FIGS. 11–14, cable release button 36 and control button 30 are conveniently exposed, enabling a user to easily take up slack in electrical cable 22 and to turn the power supply unit 12 on for application of relaxing massage to the soles of the feet.

The apparatus 10 can be easily removed and installed on various boots and shoes. Hook and loop fasteners 112, 114, 116, 117, 118 facilitate repair or replacement of the various components and air canals 64, 66, 68 provide ventilation to prevent over-heating of the vibrators 16, 18, 20 while also providing cooling air to the user's feet.

The foregoing specific embodiments of the present invention as set forth in the specification herein are for illustrative purposes only. Various deviations and modifications can be made within the spirit and scope of this invention, without departing from the main theme thereof.

I claim:

1. A vibrating foot massage insole apparatus comprising:

insole means with said insole means having an upper portion, a lower portion, a heel portion and a toe portion;

vibrator means mounted on said lower portion of said insole means; power supply means;

battery means mounted in said power supply means;

control means mounted in said power supply means; and electrical connection means with said electrical connection means connecting said vibrator means, said battery means, said power supply means and said control means, wherein said electrical connection means comprises electrical cable means and further comprising wire retracting means disposed on said power supply means for retracting said electrical cable means.

2. A vibrating foot massage insole apparatus as claimed in claim 1, wherein said lower portion of said insole means comprises an upper surface and a lower surface and in which said upper surface further comprises at least one cavity portion with said vibrator means mounted in said cavity portion.

3. A vibrating foot massage insole apparatus as claimed in claim 1, further comprising fastener means connecting said upper portion and said lower portion of said insole means.

4. A vibrating foot massage insole apparatus as claimed in claim 1, wherein said control means comprises:

a control button mounted on said power supply means.

5. A vibrating foot massage insole apparatus as claimed in claim 4, wherein said lower portion of said insole means further comprises a plurality of transverse air canals with said transverse air canals disposed in a transverse direction defined as generally perpendicular to a line drawn between said heel and toe portions of said insole means.

6. A vibrating foot massage insole apparatus as claimed in claim 1, wherein said vibrator means comprises three vibrators with a first of said vibrators mounted proximate said heel portion of said insole means, with a second of said vibrators mounted proximate said toe portion of said insole means and with a third of said vibrators disposed between said first and said second vibrators.

7. A vibrating foot massage insole apparatus as claimed in claim 1, wherein said lower portion of said insole means comprises a member having relatively greater rigidity and in which said upper portion of said insole means comprises a member having relatively lesser rigidity.

8. A vibrating foot massage insole apparatus as claimed in claim 1, wherein said transverse air canals are disposed in communication with said cavity portion.

9. A vibrating foot massage insole apparatus as claimed in claim 1, further comprising fastener means connecting said vibrator means and said insole means.

10. A vibrating foot massage insole apparatus as claimed in claim 1, further comprising fastener means connecting said upper and lower portions of said insole means.

11. A vibrating foot massage insole apparatus as claimed in claim 1, wherein said lower portion of said insole means further comprises a plurality of wire canals for mounting said electrical connection means.

12. A vibrating foot massage insole apparatus as claimed in claim 1, wherein said upper portion of said insole means is made of a perforated material.

13. A vibrating foot massage insole appartus as claimed in claim 1, wherein said upper portion of said insole means is made of a gel-like material.

14. A vibrating foot massage insole apparatus as claimed in claim 1, further comprising clip means mounted on said power supply means for attachment of said power supply means to a user's shoe.

15. A vibrating foot massage insole apparatus as claimed in claim 14, further comprising flexible strap means with said flexible strap means attached to said clip means and with said flexible strap means comprising fastener means.

16. A vibrating foot massage insole apparatus as claimed in claim 1, wherein said control means comprises control means for adjustment of the electrical output of said power supply means, thereby adjusting the vibration level produced by said vibrator means.

* * * * *